United States Patent [19]

Matsuda

[11] 4,228,566

[45] Oct. 21, 1980

[54] SLIDE FASTENER STRINGER

[75] Inventor: Yoshio Matsuda, Toyama, Japan

[73] Assignee: Yoshida Kogyo KK, Tokyo, Japan

[21] Appl. No.: 972,699

[22] Filed: Dec. 26, 1978

[30] Foreign Application Priority Data

Dec. 29, 1977 [JP] Japan ..... 52-176719[U]

[51] Int. Cl.[2] ..... A44B 19/00

[52] U.S. Cl. ..... 24/205.16 C; 66/195; 66/190

[58] Field of Search ..... 66/190–195; 24/205.1 C, 205.16 C

[56] References Cited

U.S. PATENT DOCUMENTS

| | | | |
|---|---|---|---|
| 3,974,550 | 8/1976 | Fujisaki et al. | 66/195 |
| 4,002,045 | 1/1977 | Frohlich | 66/195 |
| 4,015,450 | 4/1977 | Matsuda et al. | 66/195 |

*Primary Examiner*—Ronald Feldbaum

*Attorney, Agent, or Firm*—Bucknam and Archer

[57] ABSTRACT

A slide fastener stringer includes a warp-knit stringer tape comprising a first set of yarns forming a knit ground structure containing stitch loops in every course and wale of the tape, and a second set of yarns knit in the ground structure and each extending coursewise across at least one wale, the yarns of second set comprising textured yarns. A third set of yarns forms a plurality of chains of loops knit in the ground structure and extending along wales in at least one edge portion of the tape. A fourth set of yarns is laid in the ground structure and extends in and along the wales in the tape edge portion, on which a row of coupling elements is mounted. With the stringer tape thus constructed, the tape edge portion is tight and resistant to walewise stretch and the remainder portion is relatively coarse and roughened.

7 Claims, 9 Drawing Figures

SLIDE FASTENER STRINGER

BACKGROUND OF THE INVENTION

1. Field of the Invention

The present invention relates to a slider fastener stringer with a warp-knit stringer tape made of synthetic fibers.

2. Prior Art

There have been proposed a variety of slide fastener stringers having warp-knit stringer tapes of synthetic fibers supporting coupling elements thereon. The warp-knit stringer tapes, however, give a greater amount of resistance to the penetration of a sewing needle when sewn to garments than woven stringer tapes. The warp-knit stringer tapes while they are being attached tend to shrink due to displacement and distortion of stitches where the sewing threads pass through, causing the tape edge on which the coupling elements are mounted to get wavy or puckered. Such problems can be avoided by making a central portion of the warp-knit tape where the sewing needle penetrates structurally coarser than the remainder of the tape, to thereby ease the passing of the needle through the tape.

Another problem with the warp-knit stringer tape is that since the tape is knit of multifilaments of synthetic fiber with a view to minimizing the stretch of both warpwise and coursewise directions, the surfaces of the tape are relatively hard and slippery, allowing the tape to slip or shift on the garment on a sewing machine. The tape thus can be mounted out of place and wrinkly. One solution to such slippage has been to include in the tape two different kinds of inlaid wefts, one made of textured yarns and the other of synthetic fibers of high shrinkability, the textured yarns being bulged on a flat surface of the tape by the shrinkage of the synthetic fiber wefts so as to increase a coefficient of friction of the tape as it is held against the garment during sewing operation. The addition of such different inlaid wefts, however, necessarily results in a thickened central tape portion, which will give rise to an increased degree of resistance to the penetration therethrough of a sewing needle.

SUMMARY OF THE INVENTION

A slide fastener stringer having a warp-knit stringer tape comprises a first set of yarns forming a knit ground structure, and a second set of yarns knit in the ground structure and each extending coursewise across at least one wale, the yarns of the second set comprising textured yarns. A third set of yarns forming a plurality of chains of loops is knit in the ground structure and extends along wales in at least one of the edge portions of the tape. A forth set of yarns is laid in the ground structure and extends in and along the wales in said one of the tape edge portions.

An object of the present invention is to provide a slide fastener stringer with a warp-knit stringer tape having a coupling-element supporting edge which is structurally tight and is resistant to warpwise stretch.

Another object of the present invention is to provide a slide fastener stringer with a warp-knit stringer tape having a central portion which is relatively coarse for facilitating correct and easy stitching therethrough.

The above and other objects and advantages of the present invention will become apparent from the following description when taken in conjunction with the accompanying drawings in which some preferred embodiments are shown by way of illustrative example.

DETAILED DESCRIPTION

Figure 1:
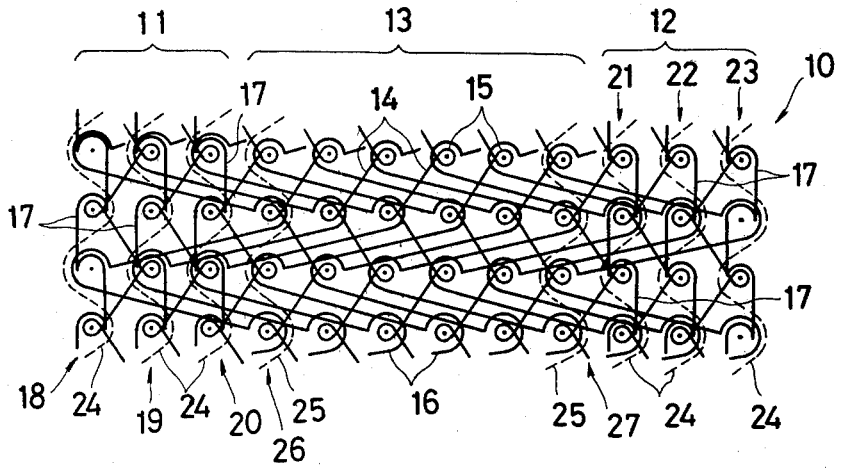
FIG. 1 is a point diagram of the patterns by which a plurality of sets of yarns are knit in a stringer tape for a slide fastener stringer according to a first embodiment of the present invention.

FIG. 1 shows a warp-knit stringer tape 10 having a pair of spaced edge portions 11, 12 on one of which a row of coupling elements is to be mounted, and a central portion 13 extending between the edge portions 11, 12, the tape 10 being adapted to be attached to a garment (not shown) by sewing threads passing through the central portion 13. The tape 10 comprises a knit ground structure formed by a first set of yarns 14 of synthetic fibers knit in the pattern: 1-2/1-0 (FIG. 2B), the ground structure thus containing stitch loops 15 in every course and wale of the tape 10. A second set of yarns 16 is knit in the tape ground structure in the pattern: 0-1/4-3 (FIG. 2C), each yarn 16 extending coursewise across four wales or three interneedle spaces. The yarns 16 of the second set comprise textured yarns. The first and second sets of yarns 14, 16 extend coursewise for the full width of the tape 10, that is, in both of the edge portion 11, 12 and the central portion 13.

Figures 2A, 2B, 2C, 2D:
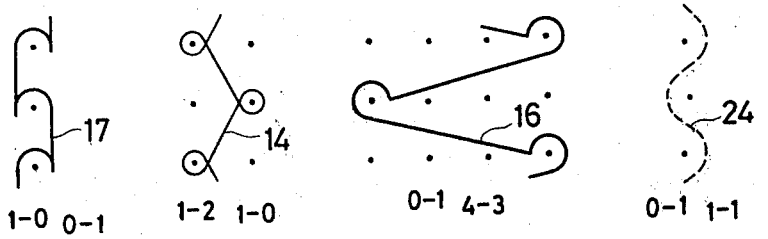
FIGS. 2A through 2D are point diagrams showing the guide bar movement for the yarns shown in FIG. 1.

Each of the tape edge portions 11, 12 further includes a third set of yarns 17 (three in the illustrated embodiment) of synthetic fibers knit in the ground structure in the pattern: 1-0/0-1 (FIG. 2A). The yarns 17 of the third set form a plurality of chains of loops and extend along three outermost wales 18, 19, and 20 in the edge portion 11 and three outermost wales 21, 22, and 23 in the edge portion 12. Additionally included in each of tape edge portions 11, 12 is a fourth set of yarns 24 (three in the illustrated embodiment) laid in the ground structure and extending in and along the wales 18, 19, and 20 (21, 22, and 23), the yarns 24 of the fourth set being laid in the pattern: 0-0/1-1 (FIG. 2D). A pair of additional yarns 25 in the pattern: 0-0/1-1 are also laid in the ground structure and extend in and along a pair of wales 26, 27, respectively in the central portion 13 which are next respectively to the wales 20, 21 in the edge portions 11, 12. Such inlaid yarns 24, 25 engage tightly with the stitch loops along the wales 18 through 23 and the wales 26, 27. With the stringer tape 10 thus constructed, the tape edge portions 11, 12 are structurally tight and are resistant to walewise stretch due to inclusion of the inlaid yarns 24. The central portion 13 of the tape 10 has a relatively course structure which will facilitate the penetration of a sewing needle therethrough.

Figure 3:
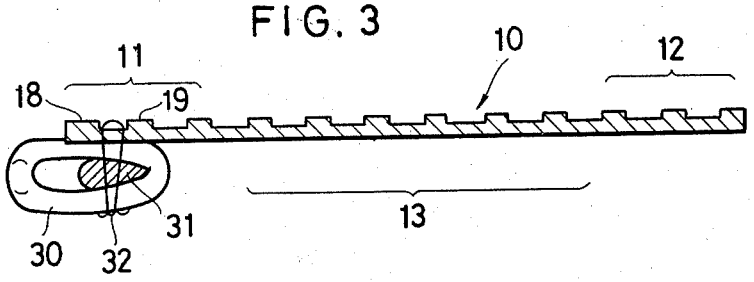
FIG. 3 is a cross-sectional view of the slide fastener stringer of the present invention.
Figure 4:
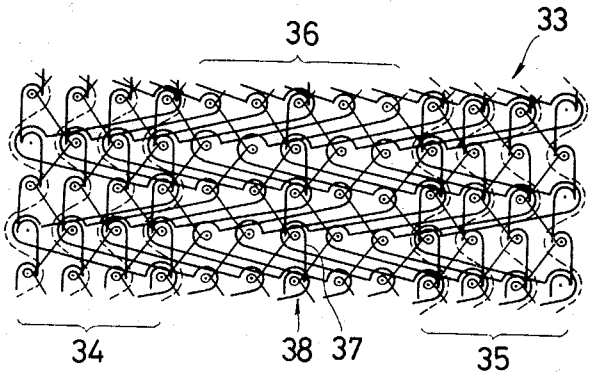
FIG. 4 is a point diagram showing the patterns of sets of yarns in a stringer tape for a slide fastener stringer according to a second embodiment.
Figure 5:
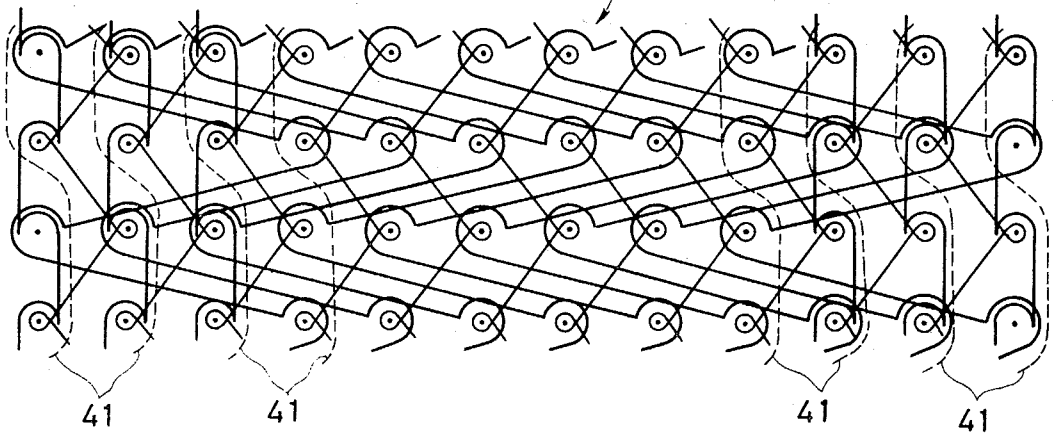
FIG. 5 is a point diagram showing the patterns of sets of yarns in a stringer tape for a slide fastener stringer according to a third embodiment.

FIG. 3 illustrates the stringer tape 10 having a row of helically coiled coupling elements 30 with a reinforcing ord 31 extending therethrough, the coupling elements 0 being sewn to one of the edge portions 11 by sewing hreads 32 positioned between the wales 18 and 19. The entral portion 13 is relatively stretchable walewise and oarsewise, so that the tape 10 will allow itself to be tretched by a pull that a slider (not shown) will impose n the tape 10 during frictional movement along the ow of coupling elements 30. The textured yarns 16 ake one of the surfaces of the tape 10 relatively roughned, thereby enabling the tape 10 to have a desired egree of softness and bulging which is comparable to hat of a garment to which the tape 10 is to be attached, nd also thereby preventing the tape 10 from slipping uring attachment onto a garment.

A stringer tape 33 of a second embodiment shown in IG. 4 has a pair of spaced edge portions 34, 35 and a entral portion 36 extending between the edge portions 4, 35, and is different from the stringer tape 10 of FIG. in that there is an additional yarn 37 forming a chain f loops knit in the ground structure and extending long a wale 38 located centrally in the central portion 6. The additional yarn 37 lessens walewise stretch of he central portion 36.

According to a third embodiment illustrated in FIG. , a stringer tape 40 is substantially similar to the tringer tape 10 of FIG. 1 except that a set of yarns 41 s laid in wales in each tape edge portion in the pattern: -0/0-0/1-1/1-1.

Figure 6:
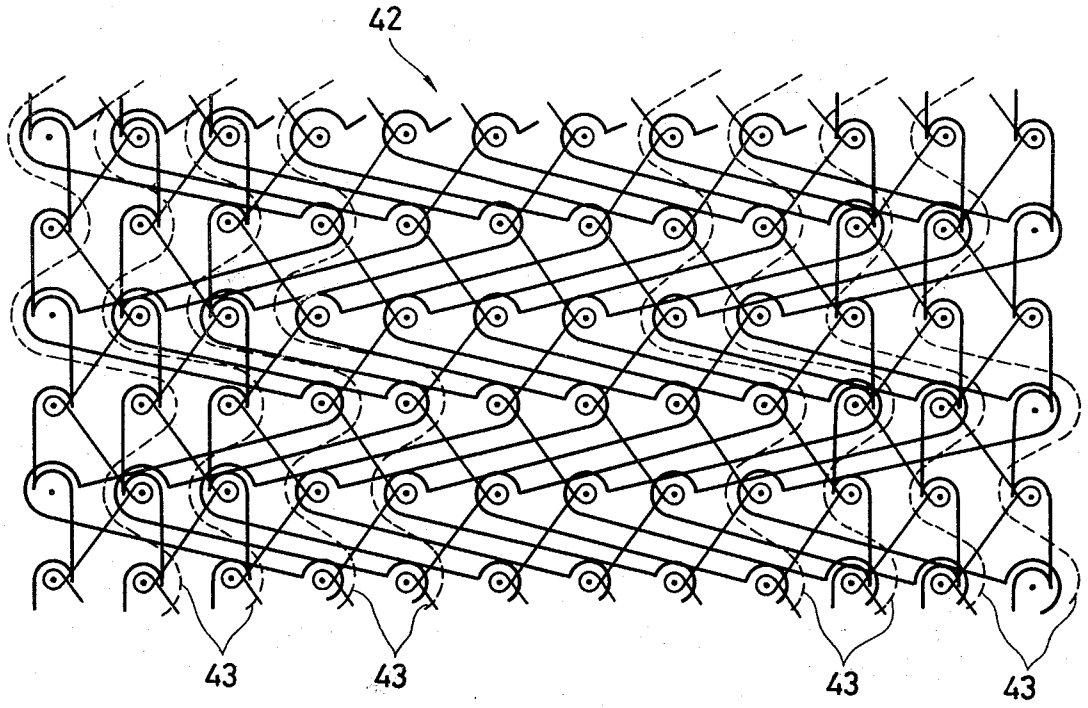
FIG. 6 is a point diagram showing the patterns of sets of yarns in a stringer tape for a slide fastener stringer according to a fourth embodiment.

In FIG. 6, a stringer tape 42 of a fourth embodiment iffers from the stringer tape 10 shown in FIG. 1 in that set of inlaid yarns 43 is included in wales in each tape dge portion in the pattern: 0-0/1-1/0-0/2-2/1-1/2-2.

Although some preferred embodiments have been hown and described in detail, is should be understood hat changes and modifications may be made without leparting from the scope of the appended claims. For xample, the inlaid yarns 25 in and along the wales 26, 7 of the tape 10 may be omitted, and the yarns 17 orming chains of loops at the outermost wales 18, 23 nay comprise thickened or paralleled yarns, in which ase the inlaid yarns 24 extending in and along such utermost wales may be dispensed with. Further, the econd set of yarns 16 may be knit in other patterns: -0/3-4, 0-1/3-2, or 1-0/2-3, for instance.

Although various minor modifications may be sugested by those versed in the art, it should be undertood that I wish to embody within the scope of the atent warranted hereon, all such embodiments as reasonably and properly come within the scope of my contribution to the art.

What is claimed is:

1. A slide fastener stringer comprising:

(a) a warp-knit stringer tape having a pair of spaced edge portions and a central portion extending between said edge portions, said stringer tape comprising:

(1) a first set of yarns forming a first knit ground structure containing stitch loops in every course and wale of said tape;

(2) a second set of yarns knit in said first ground structure and each extending coursewise across at least one wale, said yarns of the second set comprising textured yarns and forming a second knit ground structure containing stitch loops in every wale of the tape other than said one wale, said central portion consisting of said first set of yarns and said second set of yarns;

(3) a third set of yarns forming a plurality of chains of loops knit in said first and second ground structures and extending along wales in at least one of said edge portions; and (4) a fourth set of yarns laid in said first and second ground structures and extending in and along said last-named wales; and (b) a row of coupling elements mounted on and along said one of the edge portions of the tape.

2. A slide fastener stringer according to claim 1, said first set of yarns being knit in the pattern: 1-2/1-0, and said second set of yarns being knit in the pattern: 0-1/4-3.

3. A slide fastener stringer according to claim 1, said fourth set of yarns being laid in the pattern: 0-0/1-1.

4. A slide fastener stringer according to claim 1, including another yarn forming a chain of loops knit in said ground structure and extending along a wale located centrally in said central portion.

5. A slide fastener stringer according to claim 1, including another yarn laid in said ground structure and extending in and along a wale in said central portion which is next to said one of the edge portions.

6. A slide fastener stringer according to claim 1, said fourth set of yarns being knit in the pattern: 0-0/0-0/1-1/1-1.

7. A slide fastener stringer according to claim 1, said fourth set of yarns being knit in the pattern: 0-0/1-1/0-0/2-2/1-1/2-2.

* * * * *